US006418750B1

(12) United States Patent
Adam et al.

(10) Patent No.: US 6,418,750 B1
(45) Date of Patent: Jul. 16, 2002

(54) MULTI-PURPOSE CRYOGENIC SURFACE DEVICE

(75) Inventors: Neal R. Adam, Chandler; Gerard W. Wall, Pheonix, both of AZ (US)

(73) Assignee: The United States of America as represented by the Secretary of Agriculture, Washington, DC (US)

( * ) Notice: Subject to any disclaimer, the term of this patent is extended or adjusted under 35 U.S.C. 154(b) by 0 days.

(21) Appl. No.: 09/978,400

(22) Filed: Oct. 16, 2001

(51) Int. Cl.[7] ..... F17C 13/00; F17C 13/02
(52) U.S. Cl. ..... 62/457.9; 62/45.1; 62/49.2
(58) Field of Search ..... 62/457.1, 457.9, 62/458, 45.1, 49.2

(56) References Cited

U.S. PATENT DOCUMENTS 4,578,963 A 4/1986 Sitte 5,925,511 A 7/1999 Fuhr et al.

OTHER PUBLICATIONS

Adam, N. R. et al., "Multipurpose Cryogenic Surfac Apparatus: A liquid Nitrogen–Chilled Sample Tray", *Crop Science*, vol. 41, No. 3, pp. 755–758.

*Primary Examiner*—William C. Doerrler
*Assistant Examiner*—Filip Zec
(74) *Attorney, Agent, or Firm*—M. Howard Silverstein; Curtis P. Ribando; John D. Fado

(57) ABSTRACT

A cryogenically-cooled working surface in heat exchange contact with a reservoir of cryogenic fluid permits sorting or measuring cryogenically-preserved samples without the risk of damage by thawing. The portable device is suitable for laboratory or field use, is positionally stable, and easily refillable with cryogenic fluid.

18 Claims, 3 Drawing Sheets

MULTI-PURPOSE CRYOGENIC SURFACE DEVICE

BACKGROUND OF THE INVENTION

1. Field of the Invention

This invention generally relates to cryogenic storage apparatus and, more specifically, to unique features of the storage apparatus that allow the cryogenically stored sample to be removed from the cryogenic liquid for examination or manipulation without the risk of thawing the sample. This is especially important for any biological sample whose integrity would be damaged by thawing.

2. Description of the Prior Art

Cryogenic containers are used mainly for storage. When a cryogenically stored sample is removed from the cryogen, it must be processed immediately to prevent degradation of the sample before analysis. Often, the sample is removed from the cryogen and stored on ice until use. During handling, temporary storage on ice, or visual inspection, the sample often undergoes thawing. While it is often desired to preserve a sample beyond the initial evaluation or extraction of a subsample, the thaw-freeze-thaw cycle may be too destructive to sample integrity to permit return of the original sample to the cryogen for subsequent reuse.

Sitte (U.S. Pat. No. 4,578,963) discloses an apparatus for the cryofixation of specimens. The apparatus is designed to reduce the transfer of natural specimens through cold gaseous nitrogen to a minimum without incurring the risk of a detrimental accumulation of water, carbon dioxide and oxygen from the external room atmosphere on the liquid surface. The specimen is placed on a surface that is movable through a boundary between a cryogenic medium within a tank and an atmosphere external to the tank.

Fuhr et al. (U.S. Pat. No. 5,925,511) describes a method and apparatus for cryopreserving and cryogenically processing biological objects. The biological material is jetted in an enveloping solution in microdroplet form on a cooled substrate that causes the microdroplets to rapidly freeze. The substrate may contain surface structuring for maintaining the droplets in defined spacings or patterns. The frozen material is thereafter processed or stored at subfreezing temperatures.

Adam et al. [*Crop Sci.* 41:755–758 (2001)] disclose a nitrogen-chilled sample tray that allows cryogenically preserved samples to be sorted and measured without the risk of sample thawing. The tray comprises a stainless steel lid (working surface) brazed to a stainless steel pan, creating a reservoir designed to be filled with liquid nitrogen. The working surface is maintained at approximately the temperature of the liquid nitrogen. Practical limitations on the utility of the tray relate to the length of time (20–30 minutes) for the tray to reach the working temperature (−190° C.), the relatively high volume (6–8 liters) of liquid nitrogen needed to reach the working temperature, and the frequency of liquid nitrogen replenishment needed to maintain the working temperature.

SUMMARY OF THE INVENTION

We have now invented a device comprising a cryogenically-cooled working surface for manipulating a frozen sample while efficiently maintaining the sample in a frozen state throughout the manipulation. This working surface is in heat exchange contact with a reservoir of cryogenic fluid. The reservoir is contained within an insulated vessel.

In accordance with this discovery, it is an object of the invention to provide a device for laboratory or field use comprising a cryogenic surface for working with a frozen sample while maintaining the frozen integrity of the sample.

It is also an object of the invention for the aforementioned device to be portable, positionally stable, and easily refillable with cryogenic fluid.

Another object of the invention is to provide a device having a cryogenic working surface that is rapidly brought to a useful working temperature and efficiently utilizes cryogenic fluid for maintaining that temperature for extended periods of time.

A further object of the invention is that the aforementioned device be easily and inexpensively manufactured.

These and other objects and advantages of the invention will become readily apparent from the ensuing description.

DETAILED DESCRIPTION OF THE INVENTION

Figure 1:
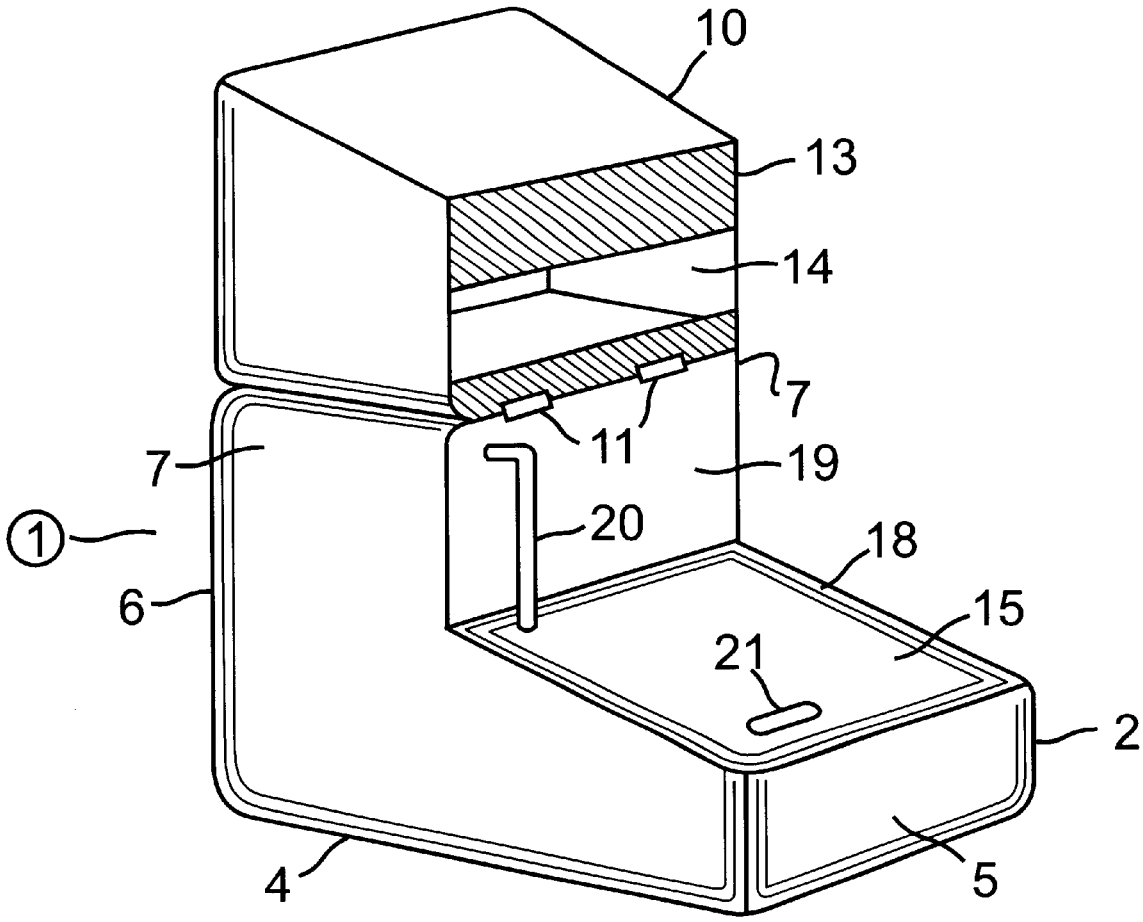
FIG. 1 shows the multipurpose cryogenic surface device in an open, work-ready, horizontal position with the working surface exposed.
Figure 2:
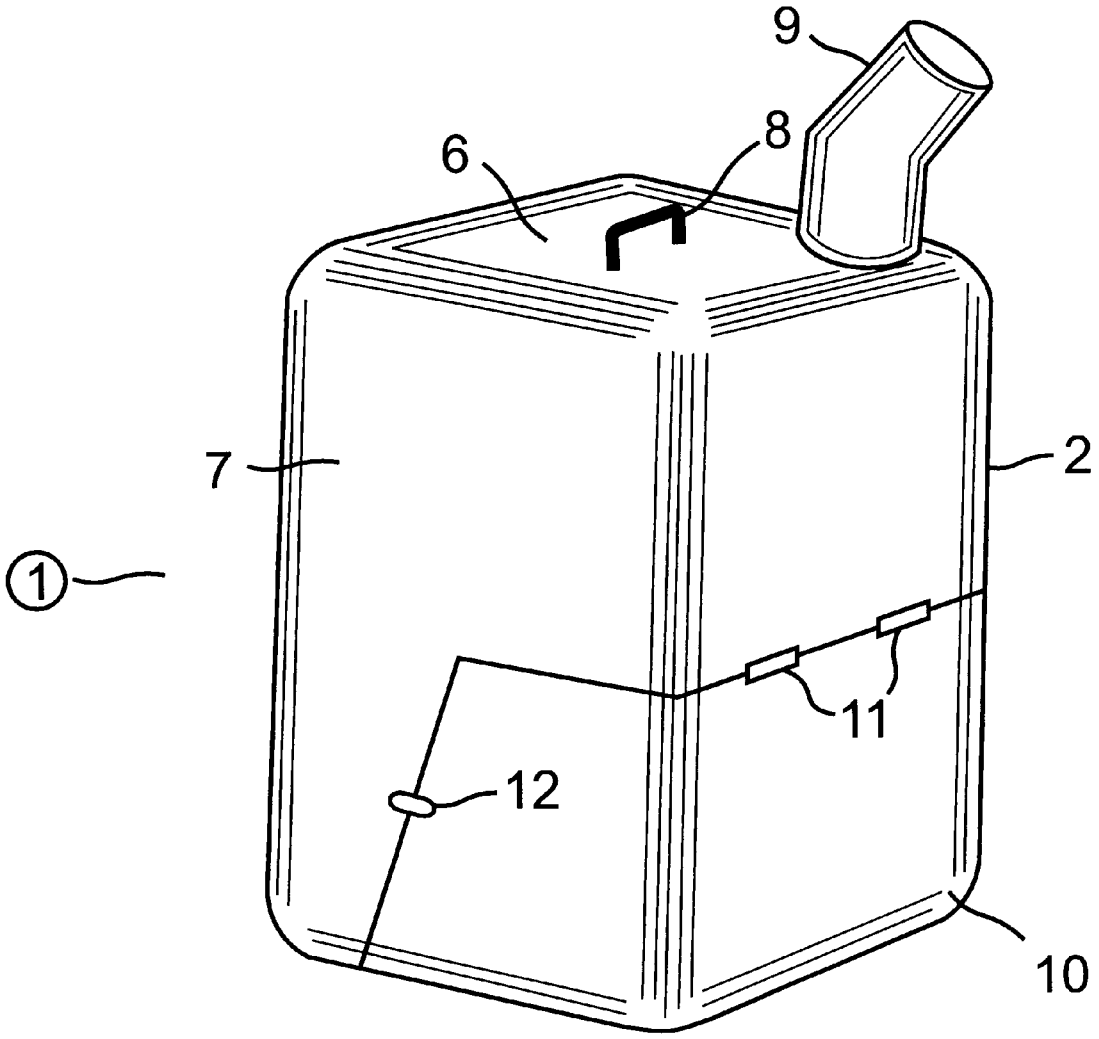
FIG. 2 is a view of the multipurpose cryogenic surface device in a closed, transportable, vertical position.
Figure 3:
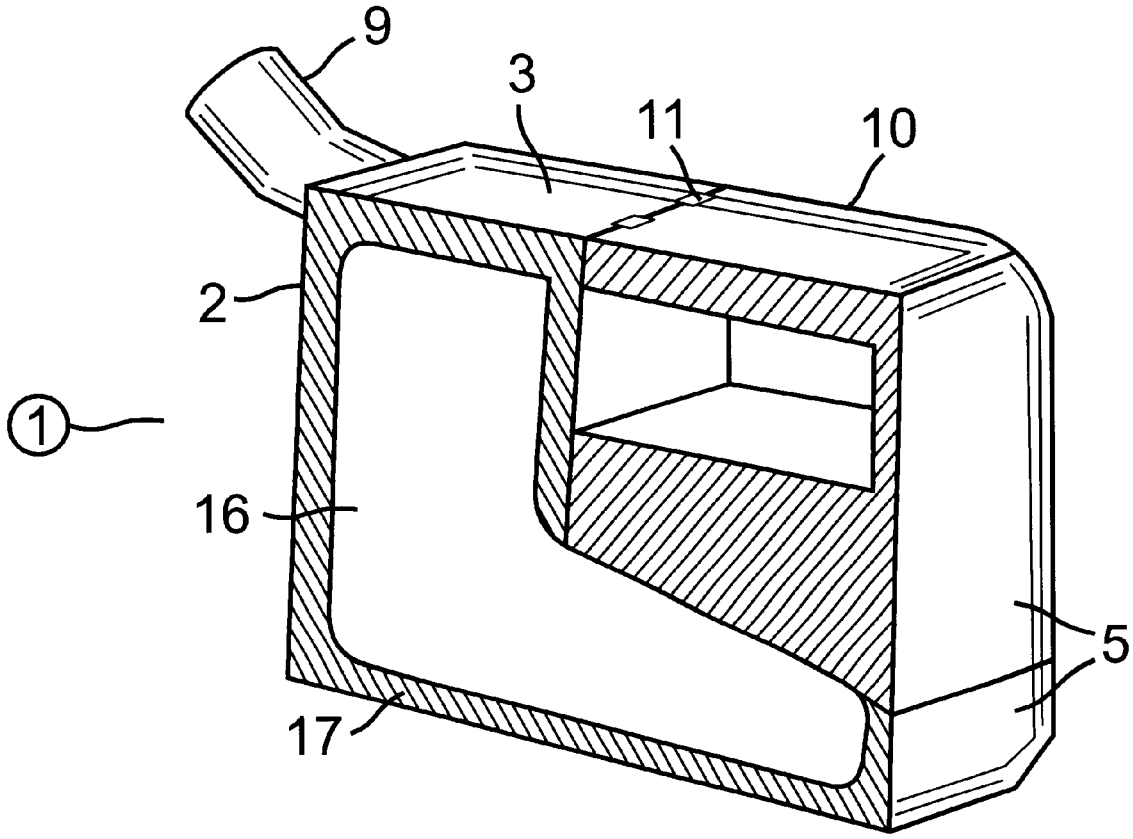
FIG. 3 is a cut-away view of the multipurpose cryogenic surface device in closed, horizontal position.

A preferred embodiment of the multi-purpose cryogenic surface device (MCS) of the invention is depicted in FIGS. 1–3. The MCS device 1 may assume a variety of exterior designs and configurations, provided that it is positionally stable when placed upon a substantially horizontal surface in any of its functional orientations as described further, below. It is particularly important that the MCS device 1 be stable when oriented in the closed "vertical" position illustrated in FIG. 2, and in the open or closed "horizontal" positions illustrated in FIGS. 1 and 3, respectively. The horizontal position is considered to be the "work-ready" or "operable" position. It is therefore preferred that the device 1 have an essentially orthogonal exterior shape, with the bottom 4 and front 5 being flat, or having feet (not shown) that will position the device in a stable and proper orientation when placed upon a flat surface.

Referring to FIGS. 1–3, the MCS device 1 comprises an insulated vessel 2 having a back 6, optionally fitted with a handle 8 useful for lifting and toting the device. The back 6 is also equipped with a curved fill spout 9 that may be integral with back 6 or otherwise secured to the device 1. The spout may have a removable cap (not shown) to inhibit loss of cryogenic fluid by evaporation or by splatter when the device 1 is being transported or moved into a different orientation. Vessel 2 or the cap for spout 9 may also be equipped with a pressure release valve. The person in the art would appreciate from the ensuing discussion that the fill spout 9 could also be located on either one of the sides 7 near the top of the device 1, provided that the mouth of the fill spout is above the level of the cryogenic fluid, whether the device 1 is in the vertical or horizontal position.

Device 1 also has a liftable lid 10. In a preferred embodiment of the invention, lid 10 is hinged to the vessel 2. In the embodiment shown in FIGS. 1–3, the lid is hinged to top 3 by means of hinges 11 and is secured in place by means of latch 12. Lid 10 includes insulation 13 and an optional storage recess 14 that can serve as a storage compartment for tools and/or sample material. When the device 1 is in the horizontal position, the lid can be pivoted 180°, such as to a resting position on the nonmovable portion of top 3. When the lid is in the open position, both working surface 15 and the opening to storage recess 14 are exposed and accessible from the front of the device 1. The opening to recess 14 can be equipped with a flap (not shown) to prevent items from falling out during transport and during movement of lid 10 when it is pivoted to the open position.

Referring to FIG. 3, the interior of device 1 comprises a reservoir 16 for holding liquid nitrogen, or other suitable cryogenic fluid. The reservoir is insulated from the ambient, and is ideally constructed similar to a storage dewar, having a shell 17 with a double-wall construction, wherein the space between the inner and outer walls is partially evacuated or contains an inert gas. In the preferred embodiment of the invention, the reservoir 16 is L-shaped. The cryogenic fluid may be added to the reservoir by means of fill spout 9 when the device 1 is in either the vertical or the horizontal position.

Working surface 15 is in heat exchange relationship with the cryogenic fluid in reservoir 16. To enhance the rate of heat exchange from the fluid to a sample placed on the working surface, the surface should be constructed from a material having high heat conductivity, such as steel or titanium. In its work-ready position, the working surface 15 is sloped upward from front to back; that is toward the upper part of the L-shaped reservoir. As a result, the working surface has an uppermost edge residing in a first horizontal plane and a lowermost edge residing in a second horizontal plane, wherein the first horizontal plane is above the second horizontal plane. The slope of the working surface allows for ergonomic access to the sample and also permits the underside of the working service to be continuously exposed to the cryogenic fluid as the fluid begins to evaporate from the reservoir (that is, air bubbles and headspace are prevented from forming between the underside of the working surface and the surface of the fluid). The actual slope of the working surface should be at least about 5° from horizontal, and preferably at least 10° from horizontal. Typically, the slope of the working surface would be in the range of 5–25°, and ideally about 15° from horizontal. Optionally, the working surface may be protected with a removable shield or glove box.

It is desirable that the volume of the reservoir be large relative to the area of the working surface in order to maximize the effective time for maintaining the working surface at the desired temperature. For example, the volume:surface area ratio would usually be at least about 5:1, and more preferably at least about 10:1. The volume of the portion of the reservoir 16 allowing for direct contact of the cryogenic fluid with the underside of the working surface 15 is preferably small relative to the total volume of the reservoir, thereby resulting in an extended period of contact of the underside of the working surface with the cryogenic fluid as the fluid level in the reservoir diminishes. For example, the ratio of that portion of the reservoir that is below the level of the top of working surface 15 (i.e. below the first horizontal plane) when the device 1 is in the horizontal (work-ready) position to the total reservoir volume is preferably less than 0.6:1, and more preferably less than 0.5:1. The greatest advantage is realized when this ratio is less than about 0.2:1. This is the proportion of the entire capacity of the reservoir that would have to contain cryogenic fluid in order for the entire underside of the working surface to be in contact with the fluid.

In the preferred embodiment of the invention, working surface 15 is surrounded on the front and two sides by a raised edge, or lip, 18. The underside of the raised edge may comprise an internal channel (e.g. an inverted U-shaped groove), intermittent or throughout the length of the raised edge. The channel would be part of, or at least in direct communication with, reservoir 16 and in contact with (i.e. contain) the cryogenic fluid. The raised edge serves as a barrier to the ambient air for maintaining the desired working temperature in the vicinity of a sample placed on the surface 15. The raised edge also serves to restrain the sample from sliding off the working surface. Working surface 15 is substantially flat, but may have any of a variety of textures, including smooth, rough, corrugated, dimpled, and/or having one or more wells 21 for holding sample material, sample vials, a pool of cryogenic fluid, tools, and the like. Interior facing surface 19 is insulated in the same manner as the exterior walls surrounding reservoir 16 and further assists in enclosing working surface 15.

Device 1 may be optionally equipped with a digital readout thermometer (not shown) having a thermocouple end attached to the working surface 15 for determining that the working surface 15 is at the desired temperature before the lid 10 is lifted. Another optional accessory would be a fluid level indicator 20 comprising a steel tube or the like, external to the reservoir and capable of projecting a frost line at the level of the cryogenic fluid within the reservoir.

The working surface is suitable for use in measuring, dividing, dissecting, and sorting cryogenically-preserved samples without the risk of thawing. Damage to enzymes, biochemicals and other labile components of biological tissues or chemical samples can be prevented during manipulation on the working surface. The multi-purpose cryogenic surface of the invention would be particularly useful for working with plant and animal tissues. For example, the device would find utility by livestock producers with a need to sort, without thawing, frozen livestock semen ampules used for artificial insemination. Other potential uses are in the biomedical/surgical field for preserving tissue samples, and in the electronic circuitry industry which processes circuit boards and fiber optics at cryogenic temperatures. The invention might also find application in the tobacco industry which processes certain tobacco extrusion products on cryogenic surfaces. Due to the compactness and portability of the cryogenic surface device, it can be used as easily in the field or other remote location as it can in the laboratory.

In preparation for use, the reservoir 16 of the MCS device 1 could be filled with cryogenic fluid in its vertical position by pouring the fluid into fill spout 9. With liftable lid 10 in the closed position, the working temperature of surface 15 is quickly attained. When liquid nitrogen is used as the cryogenic fluid, the device 1 will attain a working surface temperature on the order of about −196° C. Just prior to use, the device would be reoriented to its horizontal position, and the lid 10 opened to expose the working surface 15. As previously indicated, the reservoir 16 could also be filled prior to use, or replenished during use, with the device 1 in the horizontal orientation. With the lid 10 open and the working surface 15 exposed to the ambient, the device 1 is capable of maintaining a temperature at working surface 15 in the range of about −184° C. to −196° C. for as long as the liquid nitrogen is in contact with the underside of working surface 15 (i.e. as long as the fluid level is maintained). Tools stored on the surface will also be chilled in order to further protect the frozen sample from thawing during manipulation.

The following example is intended to further illustrate the invention, without any intent for the invention to be limited to the specific embodiments described therein.

EXAMPLE 1

An experiment was conducted to demonstrate the utility of the MCS device in preventing thawing of leaf tissue. Previously-frozen leaf discs of *Sorghum bicolor* (L.) Moench were allowed to thaw for 1, 2, 5 or 10 minutes or were maintained on the working surface of the MCS device for 10 minutes before being returned to a liquid $N_2$ storage dewar. Samples that were left in the liquid $N_2$ dewar were used as controls. Rubisco and PEPCase enzyme activity assays were conducted the following day. Although the activity of fully activated Rubisco was not affected even after 10 minutes of thawing, the initial activity of Rubisco was reduced 38% after 1 minute of thawing and 76% after 10 minutes of thawing. PEPCase activity was reduced 90% after only one minute of thawing. Samples held on the working surface of the MCS device for 10 minutes showed no reductions in activities of either enzyme.

We claim:

1. A portable device for manipulating a frozen sample while maintaining the sample in a frozen state comprising:

a. an insulated vessel;

b. a reservoir within said vessel for holding a cryogenic fluid;

c. a fill spout in communication with said reservoir for adding said cryogenic fluid to said reservoir;

d. a cryogenically-cooled working surface in heat exchange contact with said reservoir.

2. The portable device of claim 1, wherein said working surface is substantially flat.

3. The portable device of claim 1, wherein said working surface is sloped upward from front to back when the device is oriented in its work-ready position, so that said working surface has an uppermost edge residing in a first horizontal plane and a lowermost edge residing in a second horizontal plane, wherein the first horizontal plane is above the second horizontal plane.

4. The portable device of claim 3, wherein said working surface is sloped at least about 5° from horizontal.

5. The portable device of claim 1, wherein said working surface is surrounded on the front and two sides by a raised edge.

6. The portable device of claim 5, wherein said raised edge has an internal channel, wherein the channel is in direct communication with the reservoir and is in contact with the cryogenic fluid.

7. The portable device of claim 1, wherein said reservoir is L-shaped.

8. The portable device of claim 3 wherein the ratio of the volume of the reservoir below said first horizontal plane to the total reservoir volume is less than 0.6:1.

9. The portable device of claim 3 wherein the ratio of the volume of the reservoir below said first horizontal plane to the total reservoir volume is less than 0.5:1.

10. The portable device of claim 3 wherein the ratio of the volume of the reservoir below said first horizontal plane to the total reservoir volume is less than 0.2:1.

11. The portable device of claim 1, wherein the ratio of the reservoir volume to the area of the working surface is at least 5:1.

12. The portable device of claim 1, wherein the ratio of the reservoir volume to the area of the working surface is at least 10:1.

13. The portable device of claim 1 further comprising a liftable lid for covering said working surface.

14. The portable device of claim 13, wherein said liftable lid is insulated.

15. The portable device of claim 13, wherein said liftable lid is hinged to said insulated vessel to enable pivoting from a closed position to an open position.

16. The portable device of claim 15, wherein said liftable lid comprises a recess accessible from the front of the device when said lid is in the open position.

17. The portable device of claim 1, and further comprising a fluid level indicator.

18. The portable device of claim 1, wherein said working surface comprises a well.

* * * * *